US012799852B2

(12) United States Patent
Ghasripoor et al.

(10) Patent No.: US 12,799,852 B2
(45) Date of Patent: Nov. 17, 2026

(54) HYDRAULIC ENERGY TRANSFER SYSTEM WITH FLUID MIXING REDUCTION

(71) Applicant: Energy Recovery, Inc., San Leandro, CA (US)

(72) Inventors: Farshad Ghasripoor, Oakland, CA (US); Jeremy Grant Martin, Oakland, CA (US); Prem Krish, Foster City, CA (US); Baji Gobburi, San Francisco, CA (US)

(73) Assignee: Energy Recovery, Inc., San Leandro, CA (US)

( * ) Notice: Subject to any disclaimer, the term of this patent is extended or adjusted under 35 U.S.C. 154(b) by 0 days.

(21) Appl. No.: 19/260,106

(22) Filed: Jul. 3, 2025

(65) Prior Publication Data

US 2025/0334034 A1 Oct. 30, 2025

Related U.S. Application Data

(60) Continuation of application No. 17/939,547, filed on Sep. 7, 2022, now Pat. No. 12,352,143, which is a (Continued)

(51) Int. Cl.
*F04F 13/00* (2009.01)
*E21B 43/16* (2006.01)
(Continued)

(52) U.S. Cl.
CPC ..... *E21B 43/16* (2013.01); *E21B 43/2607* (2020.05); *E21B 43/267* (2013.01); *F04F 13/00* (2013.01)

(58) Field of Classification Search
CPC ..... F04F 13/00
See application file for complete search history.

(56) References Cited

U.S. PATENT DOCUMENTS 2,897,762 A 8/1959 Houvener
3,431,747 A 3/1969 Hashemi et al.
(Continued)

FOREIGN PATENT DOCUMENTS

CA 2773019 A1 9/2013
CN 1489672 A 4/2004
(Continued)

OTHER PUBLICATIONS

El-Ghonemy A. M. K., "Waste Energy Recovery in Seawater Reverse Osmosis Desalination Plants. Part 2: Case Study," Renewable and Sustainable Energy Reviews, Elseviers Science, New York, NY, US, Mar. 15, 2012, vol. 16, No. 6, DOI:10.1016/J.RSER.2012.03.057, ISSN 1364-0321, pp. 4016-4028, Apr. 6, 2012, XP028496833.
(Continued)

*Primary Examiner* — Giovanna Wright
(74) *Attorney, Agent, or Firm* — Lowenstein Sandler LLP

(57) ABSTRACT

A pressure exchanger is configured to exchange pressure between a first fluid and a second fluid. A controller is configured to control, based on first sensor data from a first sensor associated with the first fluid and second sensor data from a second sensor associated with the second fluid, a first valve associated with the first fluid and a second valve associated with the second fluid to vary proportions of the first fluid and the second fluid entering the pressure exchanger to reduce mixing of the first fluid and the second fluid in the pressure exchanger.

20 Claims, 8 Drawing Sheets

Related U.S. Application Data continuation of application No. 17/152,612, filed on Jan. 19, 2021, now Pat. No. 11,512,567, which is a continuation of application No. 17/013,318, filed on Sep. 4, 2020, now Pat. No. 11,326,430, which is a division of application No. 15/935,478, filed on Mar. 26, 2018, now Pat. No. 10,767,457, which is a continuation of application No. 14/505,885, filed on Oct. 3, 2014, now Pat. No. 9,945,216.

(60) Provisional application No. 62/033,080, filed on Aug. 4, 2014, provisional application No. 61/886,638, filed on Oct. 3, 2013.

(51) Int. Cl.
*E21B 43/26* (2006.01)
*E21B 43/267* (2006.01)

(56) References Cited

U.S. PATENT DOCUMENTS

| | | | | |
|---|---|---|---|---|
| 3,489,394 | A | 1/1970 | Stogner et al. | |
| 3,560,053 | A | 2/1971 | Ortloff | |
| 3,773,438 | A | 11/1973 | Hall et al. | |
| 3,967,542 | A | 7/1976 | Hall et al. | |
| 3,981,622 | A | 9/1976 | Hall et al. | |
| 4,478,561 | A | 10/1984 | Elliston | |
| 5,599,502 | A * | 2/1997 | Miyazaki | B01L 3/502715 422/82.04 |
| 5,797,429 | A | 8/1998 | Shumway | |
| 5,899,272 | A | 5/1999 | Loree | |
| 6,659,731 | B1 | 12/2003 | Hauge | |
| 6,773,226 | B2 | 8/2004 | Al-Hawaj | |
| 7,988,428 | B1 * | 8/2011 | MacHarg | B01D 61/06 417/313 |
| 8,573,309 | B2 | 11/2013 | Simmons | |
| 8,678,514 | B2 | 3/2014 | Efthymiou et al. | |
| 8,727,004 | B2 | 5/2014 | Bull et al. | |
| 9,328,743 | B2 | 5/2016 | Hirosawa et al. | |
| 9,546,671 | B2 | 1/2017 | Hirosawa et al. | |
| 9,945,216 | B2 | 4/2018 | Ghasripoor et al. | |
| 10,767,457 | B2 | 9/2020 | Ghasripoor et al. | |
| 11,326,430 | B2 | 5/2022 | Ghasripoor et al. | |
| 11,512,567 | B2 | 11/2022 | Ghasripoor et al. | |
| 12,352,143 | B2 * | 7/2025 | Ghasripoor | F04F 13/00 |
| 2002/0025264 | A1 | 2/2002 | Polizos et al. | |
| 2002/0146325 | A1 | 10/2002 | Shumway | |
| 2005/0166978 | A1 | 8/2005 | Brueckmann et al. | |
| 2006/0037895 | A1 | 2/2006 | Shumway | |
| 2006/0037907 | A1 | 2/2006 | Shumway | |
| 2007/0137170 | A1 | 6/2007 | Bross et al. | |
| 2009/0071902 | A1 | 3/2009 | Stover et al. | |
| 2009/0301719 | A1 | 12/2009 | Bull et al. | |
| 2009/0301725 | A1 | 12/2009 | Case et al. | |
| 2011/0008182 | A1 | 1/2011 | Krogsgard et al. | |
| 2011/0176936 | A1 | 7/2011 | Andrews | |
| 2012/0217011 | A1 | 8/2012 | Dotson et al. | |
| 2015/0184502 | A1 | 7/2015 | Krish et al. | |
| 2015/0292310 | A1 | 10/2015 | Ghasripoor et al. | |
| 2016/0032691 | A1 | 2/2016 | Richter et al. | |
| 2016/0061185 | A1 | 3/2016 | Vad | |
| 2016/0160889 | A1 | 6/2016 | Hoffman et al. | |

FOREIGN PATENT DOCUMENTS

| | | | |
|---|---|---|---|
| JP | 2004500502 | A | 1/2004 |
| JP | 2004076742 | A | 3/2004 |
| JP | 2011526972 | A | 10/2011 |
| JP | 2012143703 | A | 8/2012 |
| JP | 2012518102 | A | 8/2012 |
| JP | 2012193578 | A | 10/2012 |
| JP | 2013076379 | A | 4/2013 |
| JP | 2013204461 | A | 10/2013 |
| RU | 2006105653 | A | 7/2006 |
| RU | 57434 | U1 | 10/2006 |
| RU | 2352844 | C2 | 4/2009 |
| RU | 2016105653 | A | 8/2017 |
| WO | 2011103875 | A2 | 9/2011 |

OTHER PUBLICATIONS

Examination Report for Australian Application No. 2014331601, dated Sep. 8, 2017, 4 Pages.

Examination Report for Australian Application No. 2014331601, mailed Nov. 23, 2017, 3 Pages.

Farooque A.M., et al., "Comparative Study of Various Energy Recovery Devices used in SWRO Process," Saline Water Desalination Research Institute, issued as Technical Report No. TR.3807/EVP02005 in Dec. 2004, pp. 1-44.

Guirguis M.J., "Energy Recovery Devices in Seawater Reverse Osmosis Desalination Plants with Emphasis on Efficiency and Economical Analysis of Isobaric versus Centrifugal Devices," Scholar Commons, Graduate Theses and Dissertations, Oct. 21, 2011, (Part 1, 1-62 pgs, Part 2, 1-61 pgs).

International Preliminary Report on Patentability for International Application No. PCT/US2014/059157, mailed Apr. 14, 2016, 10 Pages.

International Search Report and Written Opinion for International Application No. PCT/US2014/059157, mailed Jun. 23, 2015, 13 Pages.

Jiaxi S., et al., "Energy Recovery Device with a Fluid Switcher for Seawater Reverse Osmosis System," Chinese Journal of Chemical Engineering, Chemical Engineering, Chemical Industry Press, Beijing, CN, Apr. 1, 2008, vol. 16, No. 2, pp. 329-332, DOI:10.1016/S1004-9541(08)60083-X, ISSN 1004-9541, XP022856577.

Lozier J., et al., "The Hydraulic Turbocharger TM: A New Type of Device for the Reduction of Feed Pump Energy Consumption in Reverse Osmosis Systems," Desalination, Elsevier, Amsterdam, NL, Nov. 1, 1989, vol. 75, No. 01/03, pp. 71-83, DOI:10.1016/0011-9164(89)85006-4, ISSN 0011-9164, XP000201291.

Office Action for Canadian Application No. 2932691, dated Mar. 1, 2017, 3 Pages.

Office Action for Russian Application No. 2016117063, dated Jun. 15, 2017, 13 Pages.

Reif, et al., "Solar-thermal Powered Desalination: Its Significant Challenges and Potential," Renewable and Sustainable Energy Reviews, Nov. 14, 2005, pp. 152-165, DOI:10.2016/j.rser.2015.03.065, XP055447505, [Retrieved on Feb. 2, 2018] Retrieved from URL: https://www.researchgate.net/publication/267771476_ENERGY_RECOVERY_DEVICE_PERFORMANCE_ANALYSIS.

Stover R.L., "Seawater Reverse Osmosis with Isobaric Energy Recovery Devices," Desalination, Elsevier, Amsterdam, NL, Jan. 24, 2007, vol. 203, No. 1-3, pp. 168-175, DOI:10.1016/j.desal.2006.03.528, ISSN 0011-9164, XP005856949.

Yihui Z., et al., "Rotary Pressure Exchanger for SWRO," School of Chemical Machinery, Dalian University of Technology, China (www.intechopen.com), Expanding Issues in Desalination, 2011, pp. 1-20, XP055641639, Retrieved from URL: http://cdn.intechweb.org/pdfs/20345.pdf.

* cited by examiner

HYDRAULIC ENERGY TRANSFER SYSTEM WITH FLUID MIXING REDUCTION

RELATED APPLICATIONS

This application is a continuation of U.S. Non-Provisional patent application Ser. No. 17/939,547, filed Sep. 7, 2022, which is a continuation of U.S. Non-Provisional patent application Ser. No. 17/152,612, filed Jan. 19, 2021, now U.S. Pat. No. 11,512,567, issued Nov. 19, 2022, which is a continuation of U.S. Non-Provisional patent application Ser. No. 17/013,318, filed Sep. 4, 2020, now U.S. Pat. No. 11,326,430, issued May 10, 2022, which is a divisional of U.S. Non-Provisional patent application Ser. No. 15/935,478, filed Mar. 26, 2018, now U.S. Pat. No. 10,767,457, issued Sep. 8, 2020, which is a continuation of U.S. Non-Provisional patent application Ser. No. 14/505,885, filed on Oct. 3, 2014, now U.S. Pat. No. 9,945,216, issued Apr. 17, 2018, which claims priority to and benefit of U.S. Provisional Patent Application No. 62/033,080, filed Aug. 4, 2014, and U.S. Provisional Patent Application No. 61/886,638, filed Oct. 3, 2013, all of which are herein incorporated by reference in their entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Well completion operations in the oil and gas industry often involve hydraulic fracturing (often referred to as fracking or fracing) to increase the release of oil and gas in rock formations. Hydraulic fracturing involves pumping a fluid (e.g., frac fluid) containing a combination of water, chemicals, and proppant (e.g., sand, ceramics) into a well at high pressures. The high pressures of the fluid increases crack size and crack propagation through the rock formation releasing more oil and gas, while the proppant prevents the cracks from closing once the fluid is depressurized. Fracturing operations use high-pressure pumps to increase the pressure of the frac fluid. Unfortunately, the proppant in the frac fluid increases wear and maintenance on the high-pressure pumps.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
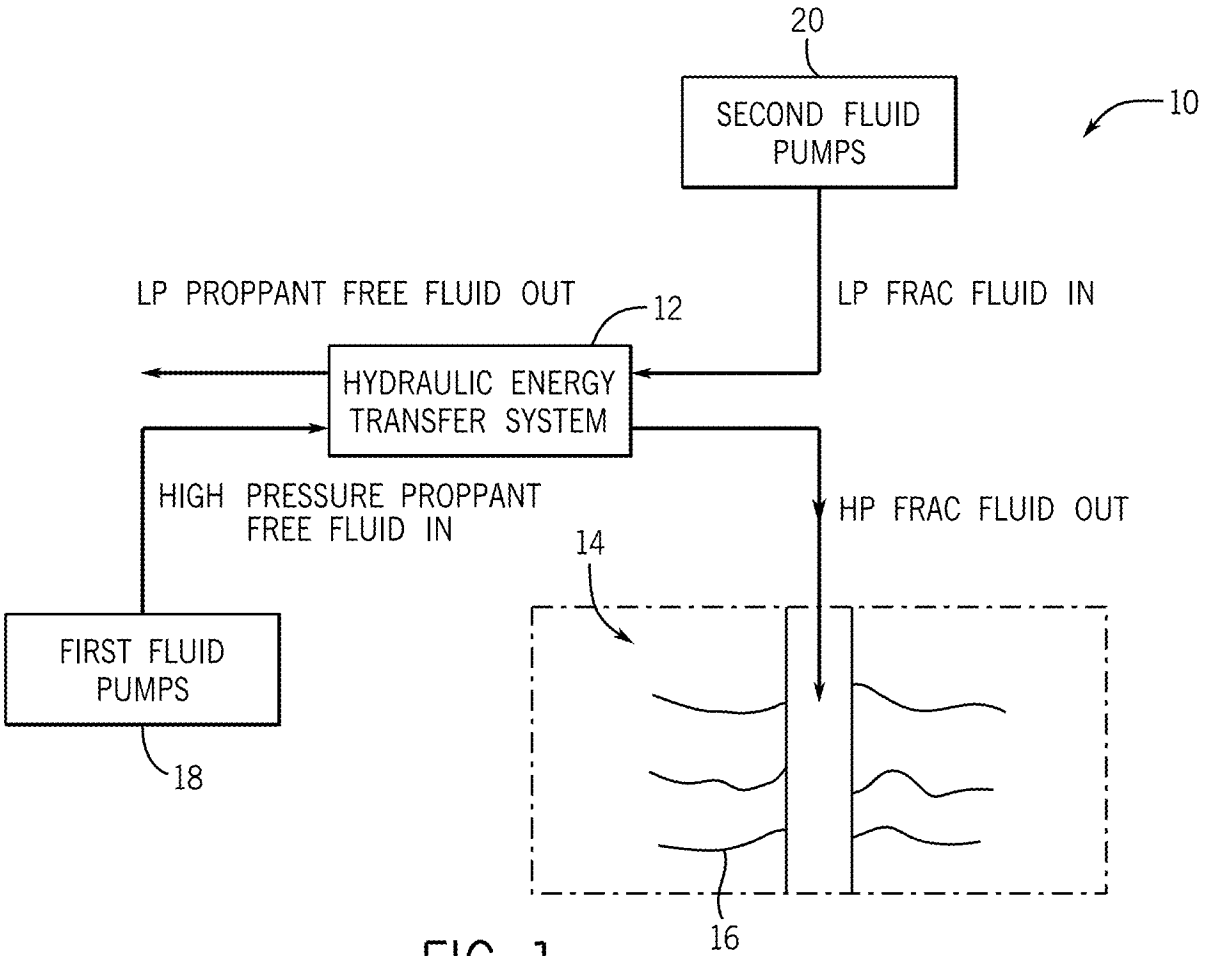
FIG. 1 is a schematic diagram of an embodiment of a frac system with a hydraulic energy transfer system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, the frac system or hydraulic fracturing system includes a hydraulic energy transfer system that transfers work and/or pressure between a first fluid (e.g., a pressure exchange fluid, such as a substantially proppant free fluid) and a second fluid (e.g., frac fluid, such as a proppant-laden fluid). For example, the first fluid may be at a first pressure between approximately 5,000 kPa to 25,000 kPa, 20,000 kPa to 50,000 kPa, 40,000 kPa to 75,000 kPa, 75,000 kPa to 100,000 kPa or greater than the second pressure of the second fluid. In operation, the hydraulic energy transfer system may or may not completely equalize pressures between the first and second fluids. Accordingly, the hydraulic energy transfer system may operate isobarically, or substantially isobarically (e.g., wherein the pressures of the first and second fluids equalize within approximately +/−1, 2, 3, 4, 5, 6, 7, 8, 9, or 10 percent of each other).

The hydraulic energy transfer system may also be described as a hydraulic protection system, hydraulic buffer system, or a hydraulic isolation system, because it blocks or limits contact between a frac fluid and various hydraulic fracturing equipment (e.g., high-pressure pumps), while still exchanging work and/or pressure between the first and second fluids. By blocking or limiting contact between various pieces of hydraulic fracturing equipment and the second fluid (e.g., proppant containing fluid), the hydraulic energy transfer system reduces abrasion/wear, thus increasing the life/performance of this equipment (e.g., high-pressure pumps). Moreover, it may enable the frac system to use less expensive equipment in the fracturing system, for example high-pressure pumps that are not designed for abrasive fluids (e.g., frac fluids and/or corrosive fluids). In some embodiments, the hydraulic energy transfer system may be a hydraulic turbocharger, a rotating isobaric pressure exchanger (e.g., rotary IPX), or a non-rotating isobaric pressure exchanger (e.g., bladder, reciprocating isobaric pressure exchanger). Rotating and non-rotating isobaric pressure exchangers may be generally defined as devices that transfer fluid pressure between a high-pressure inlet stream and a low-pressure inlet stream at efficiencies in excess of approximately 50%, 60%, 70%, 80%, or 90% without utilizing centrifugal technology.

As explained above, the hydraulic energy transfer system transfers work and/or pressure between first and second fluids. These fluids may be multi-phase fluids such as gas/liquid flows, gas/solid particulate flows, liquid/solid particulate flows, gas/liquid/solid particulate flows, or any other multi-phase flow. Moreover, these fluids may be non-Newtonian fluids (e.g., shear thinning fluid), highly viscous fluids, non-Newtonian fluids containing proppant, or highly viscous fluids containing proppant. The proppant may include sand, solid particles, powders, debris, ceramics, or any combination therefore.

FIG. 1 is a schematic diagram of an embodiment of the frac system 10 (e.g., fluid handling system) with a hydraulic energy transfer system 12. In operation, the frac system 10 enables well completion operations to increase the release of oil and gas in rock formations. The frac system 10 may include one or more first fluid pumps 18 and one or more second fluid pumps 20 coupled to a hydraulic energy transfer system 12. For example, the hydraulic energy system 12 may include a hydraulic turbocharger, rotary IPX, reciprocating IPX, or any combination thereof. In addition, the hydraulic energy transfer system 12 may be disposed on a skid separate from the other components of a frac system 10, which may be desirable in situations in which the hydraulic energy transfer system 12 is added to an existing frac system 10. In operation, the hydraulic energy transfer system 12 transfers pressures without any substantial mixing between a first fluid (e.g., proppant free fluid) pumped by the first fluid pumps 18 and a second fluid (e.g., proppant containing fluid or frac fluid) pumped by the second fluid pumps 20. In this manner, the hydraulic energy transfer system 12 blocks or limits wear on the first fluid pumps 18 (e.g., high-pressure pumps), while enabling the frac system 10 to pump a high-pressure frac fluid into the well 14 to release oil and gas. In addition, because the hydraulic energy transfer system 12 is configured to be exposed to the first and second fluids, the hydraulic energy transfer system 12 may be made from materials resistant to corrosive and abrasive substances in either the first and second fluids. For example, the hydraulic energy transfer system 12 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

Figure 2:
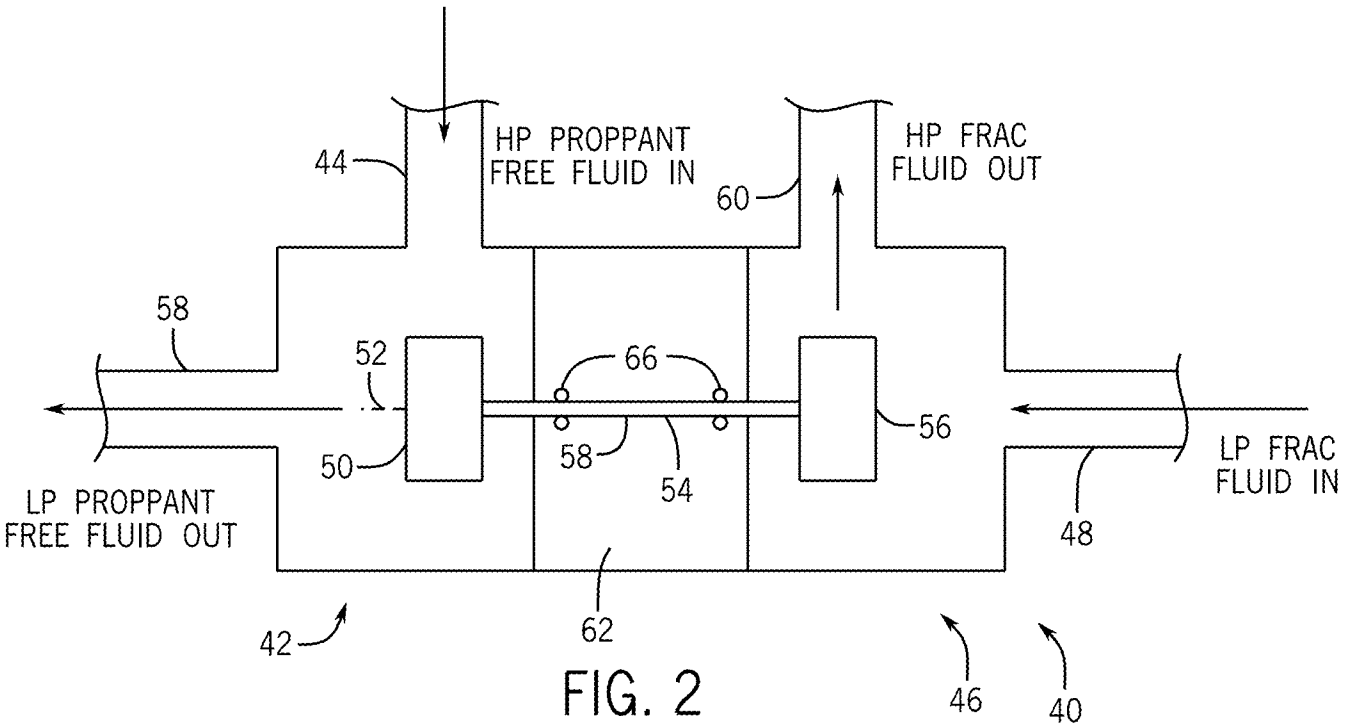
FIG. 2 is a schematic diagram of an embodiment of a hydraulic turbocharger.

FIG. 2 is a schematic diagram of an embodiment of a hydraulic turbocharger 40. As explained above, the frac system 10 may use a hydraulic turbocharger 40 as the hydraulic energy transfer system 12. In operation, the hydraulic turbocharger 40 enables work and/or pressure transfer between the first fluid (e.g., high-pressure proppant free fluid, substantially proppant free) and a second fluid (e.g., proppant containing fluid) while blocking or limiting contact (and thus mixing) between the first and second fluids. As illustrated, the first fluid enters a first side 42 of the hydraulic turbocharger 40 through a first inlet 44, and the second fluid (e.g., low-pressure frac fluid) may enter the hydraulic turbocharger 40 on a second side 46 through a second inlet 48. As the first fluid enters the hydraulic turbocharger 40, the first fluid contacts the first impeller 50 transferring energy from the first fluid to the first impeller; this drives rotation of the first impeller 50 about the axis 52. The rotational energy of the first impeller 50 is then transferred through the shaft 54 to the second impeller 56. After transferring energy to the first impeller 50, the first fluid exits the hydraulic turbocharger 40 as a low-pressure fluid through a first outlet 58. The rotation of the second impeller 56 then increases the pressure of the second fluid entering the hydraulic turbocharger 40 through the inlet 48. Once pressurized, the second fluid exits the hydraulic turbocharger 40 as a high-pressure frac fluid capable of hydraulically fracturing the well 14.

In order to block contact between the first and second fluids, the hydraulic turbocharger 40 includes a wall 62 between the first and second sides 42, 46. The wall 62 includes an aperture 64 that enables the shaft 58 (e.g., cylindrical shaft) to extend between the first and second impellers 50 and 56 but blocks fluid flow. In some embodiments, the hydraulic turbocharger 40 may include gaskets/seals 66 (e.g., annular seals) that may further reduce or block fluid exchange between the first and second fluids.

Figure 3:
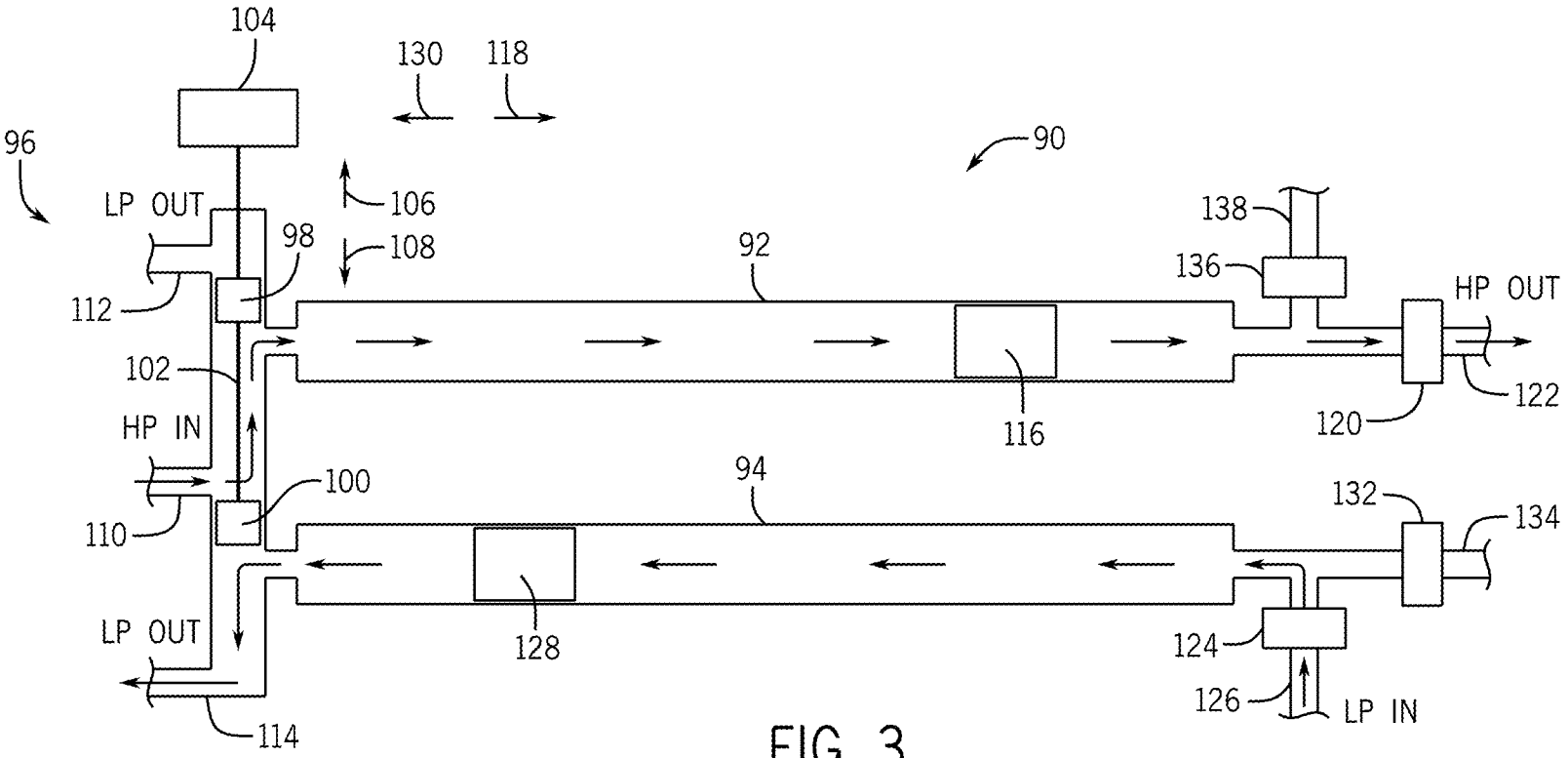
FIG. 3 is a schematic diagram of an embodiment of a reciprocating isobaric pressure exchanger (reciprocating IPX)

FIG. 3 is a schematic diagram of a reciprocating isobaric pressure exchanger 90 (reciprocating IPX). The reciprocating IPX 90 may include first and second pressure vessels 92, 94 that alternatingly transfer pressure from the first fluid (e.g., high-pressure proppant free fluid) to the second fluid (e.g., proppant containing fluid, frac fluid) using a valve 96. In other embodiments, there may be additional pressure vessels (e.g., 2, 4, 6, 8, 10, 20, 30, 40, 50, or more). As illustrated, the valve 96 includes a first piston 98, a second piston 100, and a shaft 102 that couples the first piston 98 to the second piston 100 and to a drive 104 (e.g., electric motor, hydraulic motor, combustion motor, etc.). The drive 104 drives the valve 96 in alternating axial directions 106 and 108 to control the flow of the first fluid entering through the high-pressure inlet 110. For example, in a first position, the valve 96 uses the first and second pistons 98 and 100 to direct the high-pressure first fluid into the first pressure vessel 92, while blocking the flow of high-pressure first fluid into the second pressure vessel 94 or out of the valve 96 through the low-pressure outlets 112 and 114. As the high-pressure first fluid enters the first pressure vessel 92, the first fluid drives a pressure vessel piston 116 in axial direction 118, which increase the pressure of the second fluid within the first pressure vessel 92. Once the second fluid reaches the appropriate pressure, a high-pressure check valve 120 opens enabling high-pressure second fluid to exit the reciprocating IPX 90 through the high-pressure outlet 122 for use in fracing operations. While the first pressure vessel 92 discharges, the reciprocating IPX 90 prepares the second pressure vessel 94 to pressurize the second fluid. As illustrated, low-pressure second fluid enters the second pressure vessel 94 through a low-pressure check valve 124 coupled to a low-pressure second fluid inlet 126. As the second fluid fills the second pressure vessel 94, the second fluid drives a pressure vessel piston 128 in axial direction 130 forcing low-pressure first fluid out of the second pressure vessel 94 and out of the valve 96 through the low-pressure outlet 114, preparing the second pressure vessel 94 to receive high-pressure first fluid.

Figure 4:
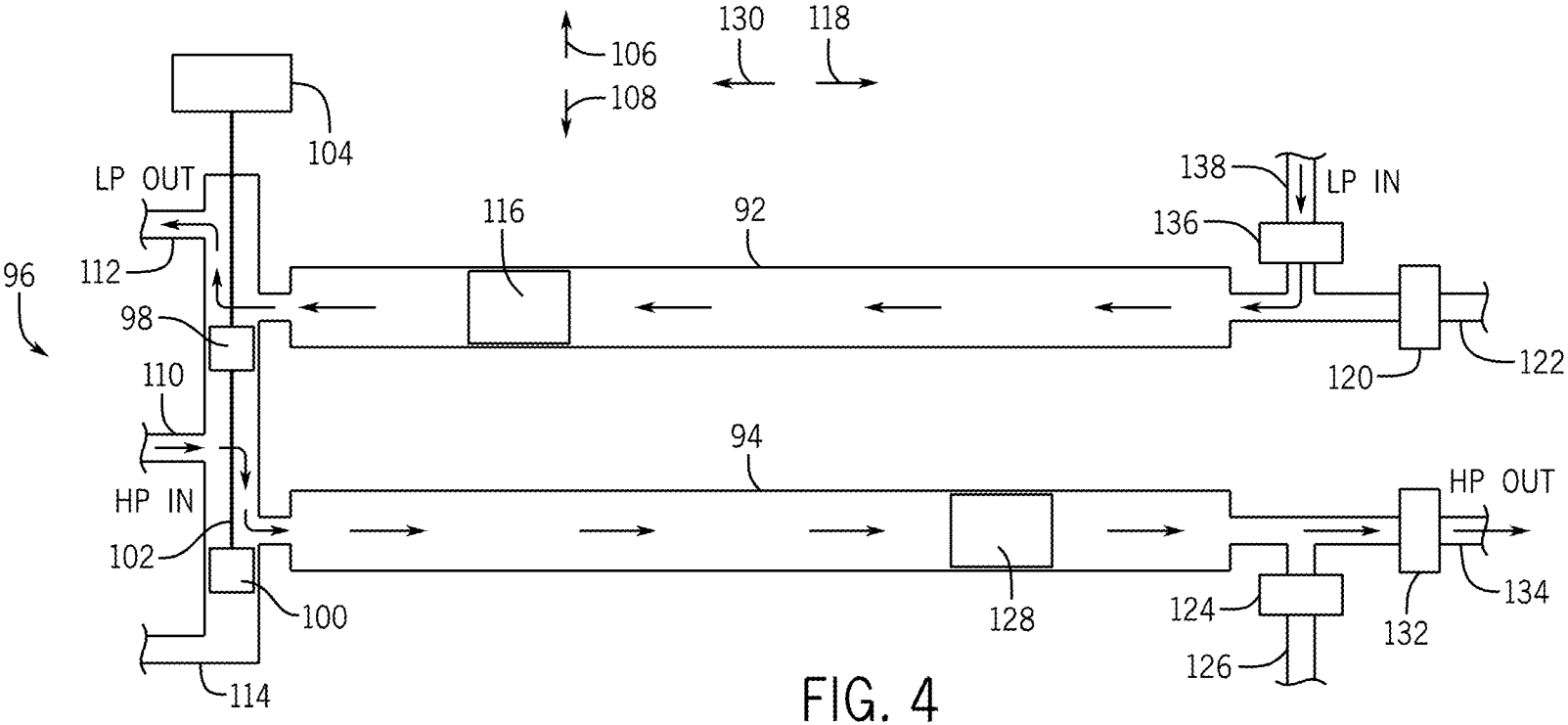
FIG. 4 is a schematic diagram of an embodiment of a reciprocating IPX.

FIG. 4 is a schematic diagram of the reciprocating IPX 90 with the second pressure vessel 94 discharging high-pressure second fluid, and the first pressure vessel 92 filling with low-pressure second fluid. As illustrated, the valve 96 is in a second position. In the second position, the valve 96 directs the high-pressure first fluid into the second pressure vessel 94, while blocking the flow of high-pressure first fluid into the first pressure vessel 92, or out of valve 96 through the low-pressure outlets 112 and 114. As the high-pressure first fluid enters the second pressure vessel 94, the first fluid drives the pressure vessel piston 128 in axial direction 118 to increase the pressure of the second fluid within the second pressure vessel 94. Once the second fluid reaches the appropriate pressure, a high-pressure check valve 132 opens enabling high-pressure second fluid to exit the reciprocating IPX 90 through the high-pressure outlet 134 for use in fracing operations. While the second pressure vessel 94 discharges, the first pressure vessel 92 fills with the second fluid passing through a low-pressure check valve 136 coupled to a low-pressure second fluid inlet 138. As the second fluid fills the first pressure vessel 92, the second fluid drives the pressure vessel piston 116 in axial direction 130 forcing low-pressure first fluid out of the first pressure vessel 92 and out through the low-pressure outlet 112. In this manner, the reciprocating IPX 90 alternatingly transfers pressure from the first fluid (e.g., high-pressure proppant free fluid) to the second fluid (e.g., proppant containing fluid, frac fluid) using the first and second pressure vessels 90, 92. Moreover, because the pressure vessel pistons 116 and 128 separate the first and second fluids, the reciprocating IPX 90 is capable of protecting fracing system equipment (e.g., high-pressure fluid pumps fluidly coupled to the high-pressure inlet 110) from contact with the second fluid (e.g., corrosive and/or proppant containing fluid).

Figure 5:
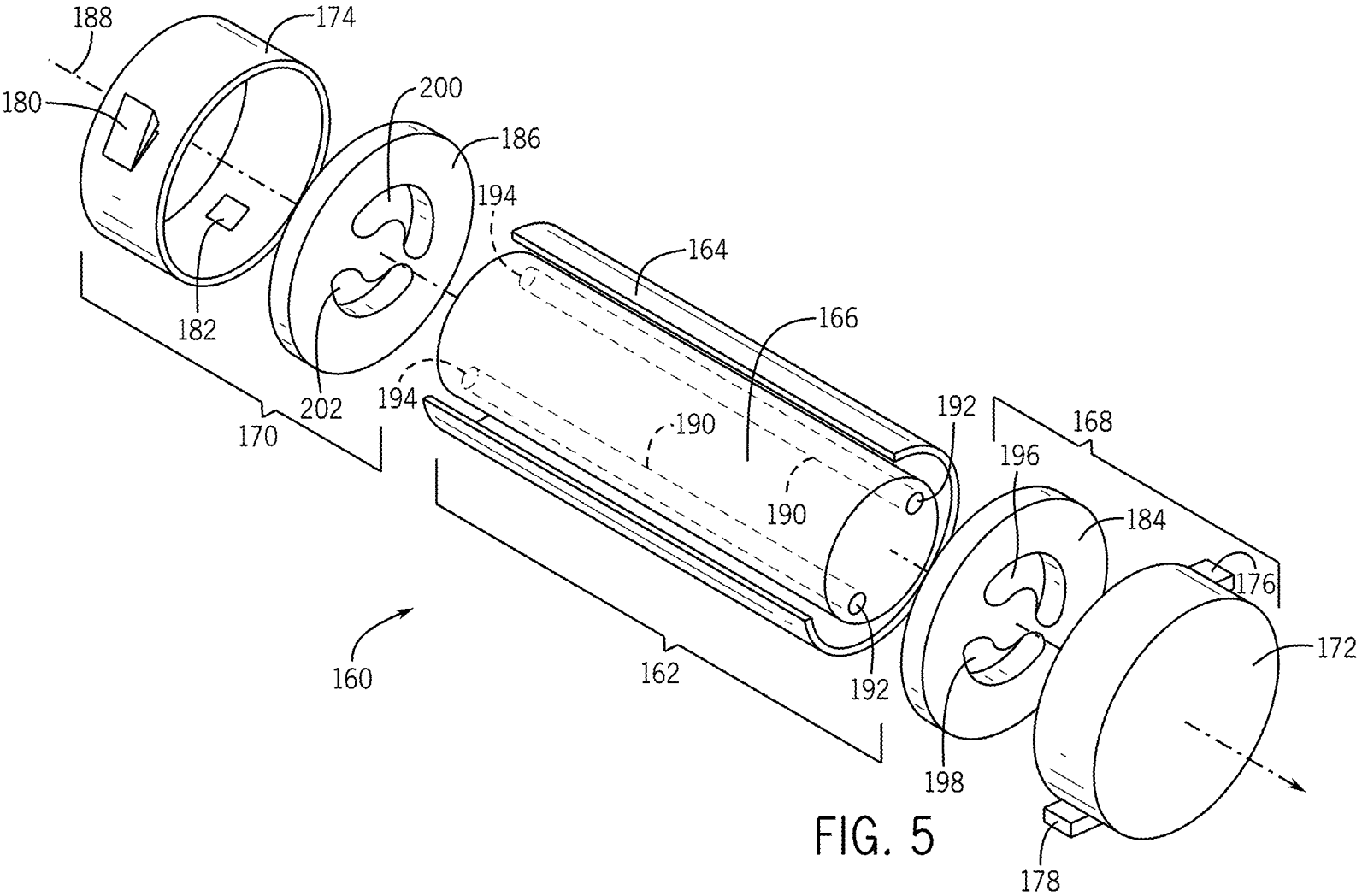
FIG. 5 is an exploded perspective view of an embodiment of a rotary isobaric pressure exchanger (rotary IPX)

FIG. 5 is an exploded perspective view of an embodiment of a rotary isobaric pressure exchanger 160 (rotary IPX) capable of transferring pressure and/or work between first and second fluids (e.g., proppant free fluid and proppant laden fluid) with minimal mixing of the fluids. The rotary IPX 160 may include a generally cylindrical body portion 162 that includes a sleeve 164 and a rotor 166. The rotary IPX 160 may also include two end caps 168 and 170 that include manifolds 172 and 174, respectively. Manifold 172 includes respective inlet and outlet ports 176 and 178, while manifold 174 includes respective inlet and outlet ports 180 and 182. In operation, these inlet ports 176, 180 enabling the first fluid (e.g., proppant free fluid) to enter the rotary IPX 160 to exchange pressure, while the outlet ports 180, 182 enable the first fluid to then exit the rotary IPX 160. In operation, the inlet port 176 may receive a high-pressure first fluid, and after exchanging pressure, the outlet port 178 may be used to route a low-pressure first fluid out of the rotary IPX 160. Similarly, inlet port 180 may receive a low-pressure second fluid (e.g., proppant containing fluid, frac fluid) and the outlet port 182 may be used to route a high-pressure second fluid out of the rotary IPX 160. The end caps 168 and 170 include respective end covers 184 and 186 disposed within respective manifolds 172 and 174 that enable fluid sealing contact with the rotor 166. The rotor 166 may be cylindrical and disposed in the sleeve 164, which enables the rotor 166 to rotate about the axis 188. The rotor 166 may have a plurality of channels 190 extending substantially longitudinally through the rotor 166 with openings 192 and 194 at each end arranged symmetrically about the longitudinal axis 188. The openings 192 and 194 of the rotor 166 are arranged for hydraulic communication with inlet and outlet apertures 196 and 198; and 200 and 202 in the end covers 172 and 174, in such a manner that during rotation the channels 190 are exposed to fluid at high-pressure and fluid at low-pressure. As illustrated, the inlet and outlet apertures 196 and 198, and 78 and 80 may be designed in the form of arcs or segments of a circle (e.g., C-shaped).

In some embodiments, a controller using sensor feedback may control the extent of mixing between the first and second fluids in the rotary IPX 160, which may be used to improve the operability of the fluid handling system. For example, varying the proportions of the first and second fluids entering the rotary IPX 160 allows the plant operator to control the amount of fluid mixing within the hydraulic energy transfer system 12. Three characteristics of the rotary IPX 160 that affect mixing are: (1) the aspect ratio of the rotor channels 190, (2) the short duration of exposure between the first and second fluids, and (3) the creation of a fluid barrier (e.g., an interface) between the first and second fluids within the rotor channels 190. First, the rotor channels 190 are generally long and narrow, which stabilizes the flow within the rotary IPX 160. In addition, the first and second fluids may move through the channels 190 in a plug flow regime with very little axial mixing. Second, in certain embodiments, the speed of the rotor 166 reduces contact between the first and second fluids. For example, the speed of the rotor 166 may reduce contact times between the first and second fluids to less than approximately 0.15 seconds, 0.10 seconds, or 0.05 seconds. Third, a small portion of the rotor channel 190 is used for the exchange of pressure between the first and second fluids. Therefore, a volume of fluid remains in the channel 190 as a barrier between the first and second fluids. All these mechanisms may limit mixing within the rotary IPX 160. Moreover, in some embodiments, the rotary IPX 160 may be designed to operate with internal pistons that isolate the first and second fluids while enabling pressure transfer.

FIGS. 6-9 are exploded views of an embodiment of the rotary IPX 160 illustrating the sequence of positions of a single channel 190 in the rotor 166 as the channel 190 rotates through a complete cycle. It is noted that FIGS. 6-9 are simplifications of the rotary IPX 160 showing one channel 190, and the channel 190 is shown as having a circular cross-sectional shape. In other embodiments, the rotary IPX 160 may include a plurality of channels 190 with the same or different cross-sectional shapes (e.g., circular, oval, square, rectangular, polygonal, etc.). Thus, FIGS. 6-9 are simplifications for purposes of illustration, and other embodiments of the rotary IPX 160 may have configurations different from that shown in FIGS. 6-9. As described in detail below, the rotary IPX 160 facilitates pressure exchange between first and second fluids (e.g., proppant free fluid and proppant-laden fluid) by enabling the first and second fluids to momentarily contact each other within the rotor 166. In certain embodiments, this exchange happens at speeds that result in limited mixing of the first and second fluids.

Figures 6, 7, 8, 9:
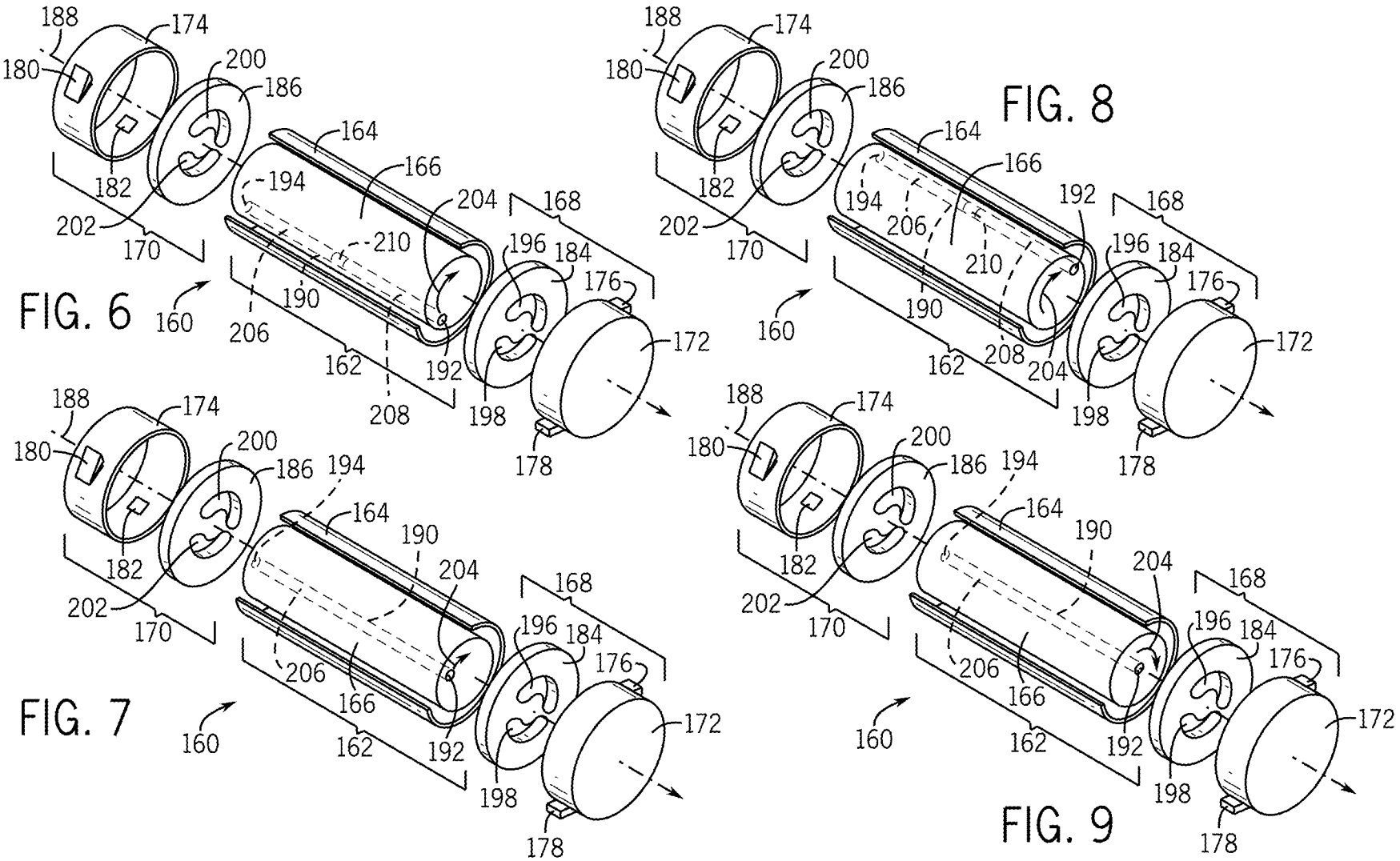
FIG. 6 is an exploded perspective view of an embodiment of a rotary IPX in a first operating position.
FIG. 7 is an exploded perspective view of an embodiment of a rotary IPX in a second operating position.
FIG. 8 is an exploded perspective view of an embodiment of a rotary IPX in a third operating position.
FIG. 9 is an exploded perspective view of an embodiment of a rotary IPX in a fourth operating position.

In FIG. 6, the channel opening 192 is in a first position. In the first position, the channel opening 192 is in fluid communication with the aperture 198 in endplate 184 and therefore with the manifold 172, while opposing channel opening 194 is in hydraulic communication with the aperture 202 in end cover 186 and by extension with the manifold 174. As will be discussed below, the rotor 166 may rotate in the clockwise direction indicated by arrow 204. In operation, low-pressure second fluid 206 passes through end cover 186 and enters the channel 190, where it contacts the first fluid 208 at a dynamic fluid interface 210. The second fluid 206 then drives the first fluid 208 out of the channel 190, through end cover 184, and out of the rotary IPX 160. However, because of the short duration of contact, there is minimal mixing between the second fluid 206 and the first fluid 208.

In FIG. 7, the channel 190 has rotated clockwise through an arc of approximately 90 degrees. In this position, the outlet 194 is no longer in fluid communication with the apertures 200 and 202 of end cover 186, and the opening 192 is no longer in fluid communication with the apertures 196 and 198 of end cover 184. Accordingly, the low-pressure second fluid 206 is temporarily contained within the channel 190.

In FIG. 8, the channel 190 has rotated through approximately 180 degrees of arc from the position shown in FIG. 6. The opening 194 is now in fluid communication with aperture 200 in end cover 186, and the opening 192 of the channel 190 is now in fluid communication with aperture 196 of the end cover 184. In this position, high-pressure first fluid 208 enters and pressurizes the low-pressure second fluid 206 driving the second fluid 206 out of the fluid channel 190 and through the aperture 200 for use in the frac system 10.

In FIG. 9, the channel 190 has rotated through approximately 270 degrees of arc from the position shown in FIG. 6. In this position, the outlet 194 is no longer in fluid communication with the apertures 200 and 202 of end cover 186, and the opening 192 is no longer in fluid communication with the apertures 196 and 198 of end cover 184. Accordingly, the first fluid 208 is no longer pressurized and is temporarily contained within the channel 190 until the rotor 166 rotates another 90 degrees, starting the cycle over again.

Figure 10:
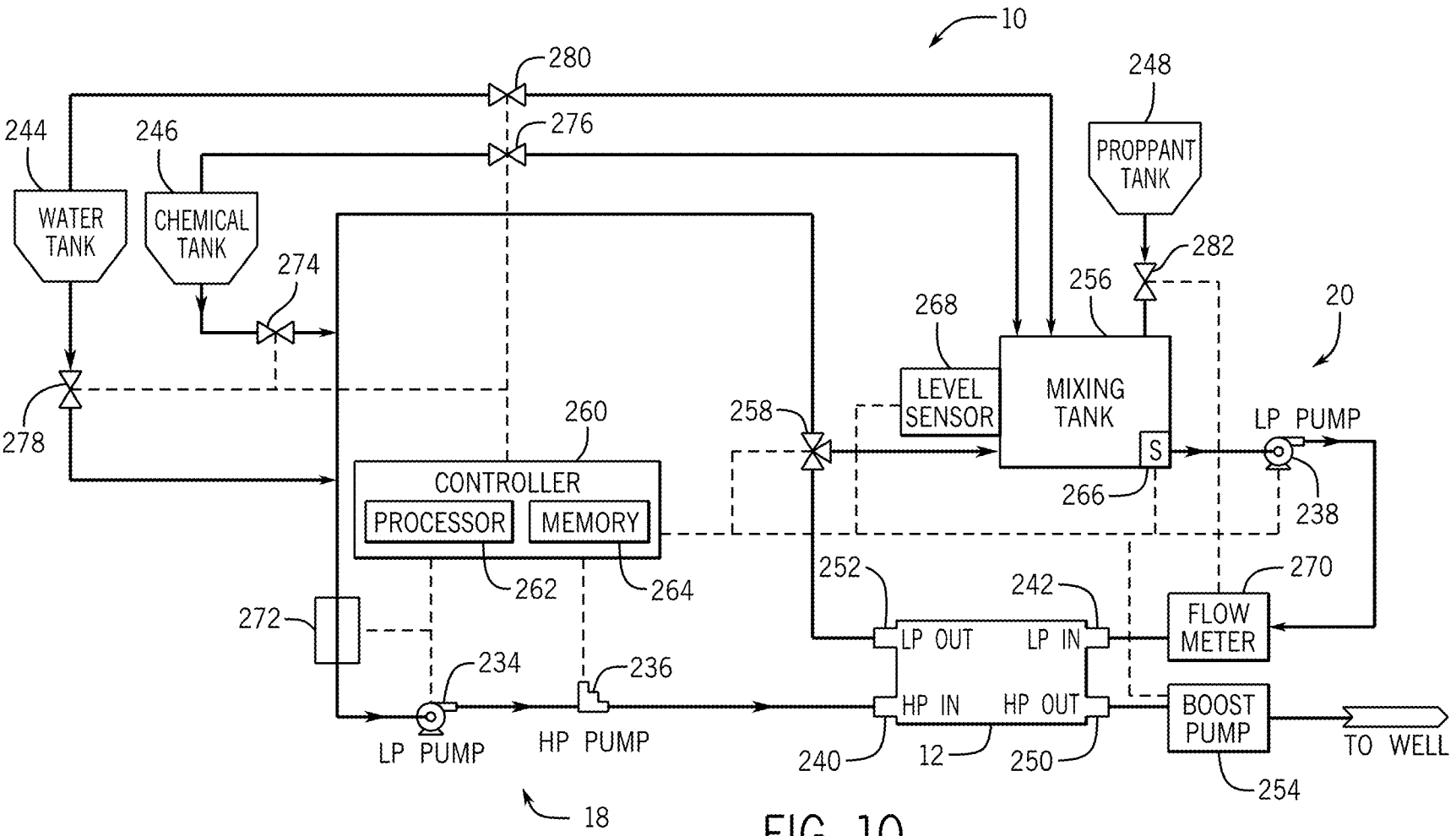
FIG. 10 is a schematic diagram of an embodiment of a frac system with a hydraulic energy transfer system.

FIG. 10 is a schematic diagram of an embodiment of the frac system 10 where the hydraulic energy transfer system 12 may be a hydraulic turbocharger 40, a reciprocating IPX 90, or a combination thereof. As explained above, the hydraulic turbocharger 40 or reciprocating IPX 90 protect hydraulic fracturing equipment (e.g., high-pressure pumps), while enabling high-pressure frac fluid to be pumped into the well 14 during fracing operations. As illustrated, the frac system 10 includes one or more first fluid pumps 18 and one or more second fluid pumps 20. The first fluid pumps 18 may include a low-pressure pump 234 and a high-pressure pump 236, while the second fluid pumps 20 may include a low-pressure pump 238. In some embodiments, the frac system 10 may include additional first fluid pumps 18 (e.g., additional low-, intermediate-, and/or high-pressure pumps) and second fluid pumps 20 (e.g., low-pressure pumps). In operation, the first fluid pumps 18 and second fluid pumps 20 pump respective first and second fluids (e.g., proppant free fluid and proppant laden fluid) into the hydraulic energy transfer system 12 where the fluids exchange work and pressure. As explained above, the hydraulic turbocharger 40 and reciprocating IPX 90 exchange work and pressure without mixing the first and second fluids. As a result, the hydraulic turbocharger 40 and reciprocating IPX 90 high-pressure pump 236 protect the first fluid pumps 18 from exposure to the second fluid (e.g., proppant containing fluid). In other words, the second fluid pumps 18 are not subject to increased abrasion and/or wear caused by the proppant (e.g., solid particulate).

As illustrated, the first fluid low-pressure pump 234 fluidly couples to the first fluid high-pressure pump 236. In operation, the first fluid low-pressure pump 234 receives the first fluid (e.g., proppant free fluid, substantially proppant free fluid) and increases the pressure of the first fluid for use by the first fluid high-pressure pump 236. The first fluid may be a combination of water from a water tank 244 and chemicals from a chemical tank 246. However, in some embodiments, the first fluid may be only water or substantially water (e.g., 50, 60, 70, 80, 90, 95, or more percent water). The first fluid high-pressure pump 236 then pumps the first fluid through a high-pressure inlet 240 and into the hydraulic energy transfer system 12. The pressure of the first fluid then transfers to the second fluid (e.g., proppant laden fluid, frac fluid), which enters the hydraulic energy transfer system 12 through a second fluid low-pressure inlet 242. The second fluid is a frac fluid containing proppant (e.g., sand, ceramic, etc.) from a proppant tank 248. After exchanging pressure, the second fluid exits the hydraulic energy transfer system 12 through a high-pressure outlet 250 and enters the well 14, while the first fluid exits at a reduced pressure through the low-pressure outlet 252. In some embodiments, the frac system 10 may include a boost pump 254 that further raises the pressure of the second fluid before entering the well 14.

After exiting the outlet 252 at a low-pressure, the first fluid may be recirculated through the first fluid pumps 18 and/or pass through the mixing tank 256. For example, a three-way valve 258 may control whether all of or a portion of the first fluid is recirculated through the first fluid pumps 18, or whether all of or a portion of the first fluid is directed through the mixing tank 256 to form the second fluid. If the first fluid is directed to the mixing tank 256, the mixing tank 256 combines the first fluid with proppant from the proppant tank 248 to form the second fluid (e.g., frac fluid). In some embodiments, the mixing tank 256 may receive water and chemicals directly from the water tank 244 and the chemical tank 246 to supplement or replace the first fluid passing through the hydraulic energy transfer system 12. The mixing tank 256 may then combine these fluids with proppant from the proppant tank 248 to produce the second fluid (e.g., frac fluid).

In order to control the composition (e.g., the percentages of chemicals, water, and proppant) and flow of the first and second fluids, the frac system 10 may include a controller 260. For example, the controller 260 may maintain flow, composition, and pressure of the first and second fluids within threshold ranges, above a threshold level, and/or below a threshold level. The controller 260 may include one or more processors 262 and a memory 264 that receives feedback from sensors 266 and 268; and flow meters 270 and 272 in order to control the composition and flow of the first and second fluids into the hydraulic energy transfer system 12. For example, the controller 260 may receive feedback from sensor 266 that indicates the chemical composition of the second fluid is incorrect. In response, the controller 260 may open or close valves 274 or 276 to change the amount of chemicals entering the first fluid or entering the mixing tank 256 directly. In another situation, the controller 260 may receive a signal from the flow meter 272 in the first fluid flow path that indicates a need for an increased flow rate of the first fluid. Accordingly, the controller 260 may open valve 278 and valve 274 to increase the flow of water and chemicals through the frac system 10. The controller 260 may also monitor the composition (e.g., percentage of proppant, water, etc.) of the second fluid in the mixing tank 256 with the level sensor 268 (e.g., level control). If the composition is incorrect, the controller 260 may open and close valves 258, 274, 276, 278, 280, and 282 to increase or decrease the flow of water, chemicals, and/or proppant into the mixing tank 256. In some embodiments, the frac system 10 may include a flow meter 270 coupled to the fluid flow path of the second fluid. In operation, the controller 260 monitors the flow rate of the second fluid into the hydraulic energy transfer system 12 with the flow meter 270. If the flow rate of the second fluid is too high or low, the controller 260 may open and close valves 258, 274, 276, 278, 280, and 282 and/or control the second fluid pumps 20 to increase or reduce the second fluid's flow rate.

Figure 11:
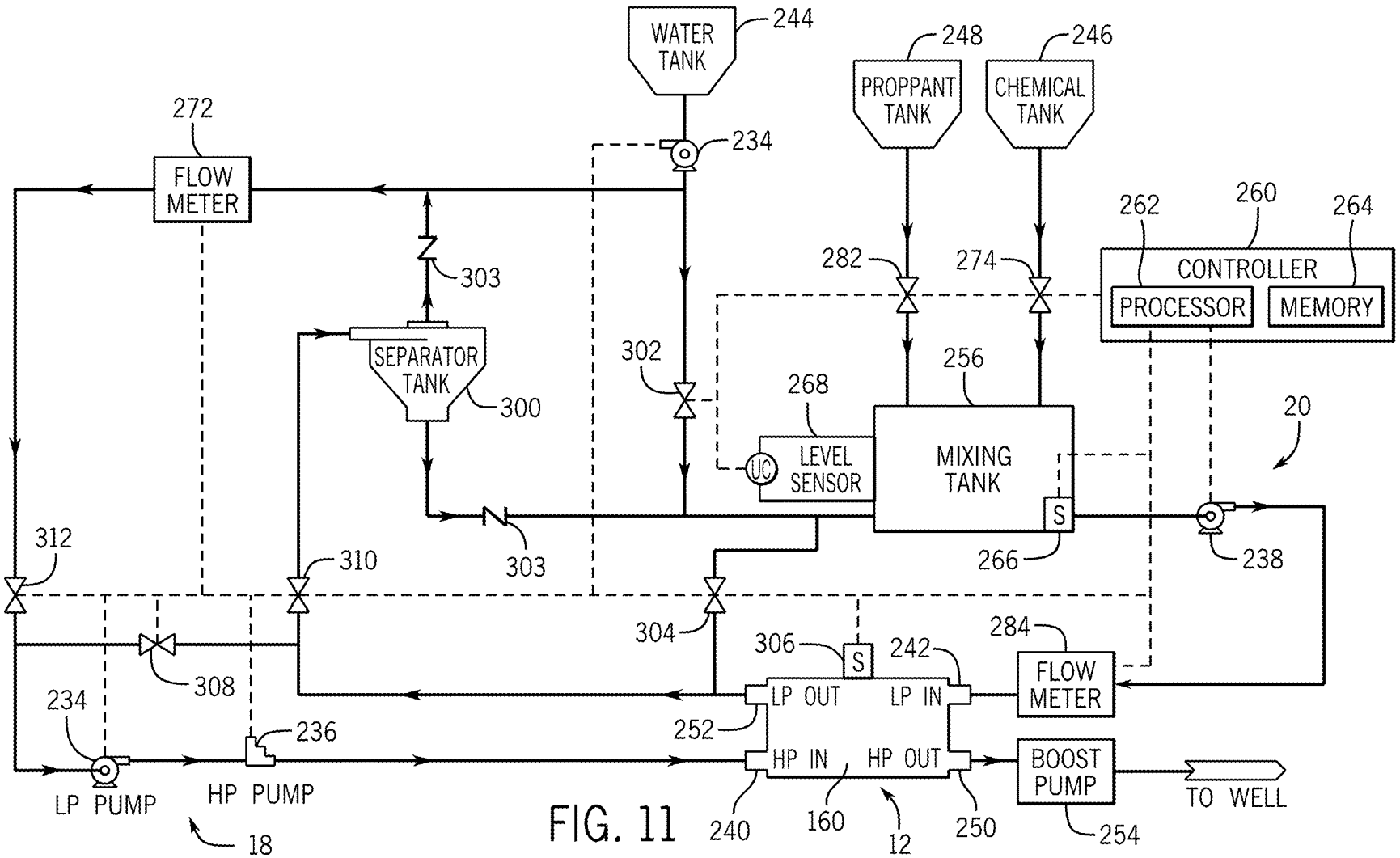
FIG. 11 is a schematic diagram of an embodiment of a frac system with a hydraulic energy transfer system.

FIG. 11 is a schematic diagram of an embodiment of the frac system 10 where the hydraulic energy transfer system 12 may be the rotary IPX 160. As illustrated, the frac system 10 includes one or more first fluid pumps 18 and one or more second fluid pumps 20. The first fluid pumps 18 may include one or more low-pressure pumps 234 and one or more high-pressure pumps 236, while the second fluid pumps 20 may include one or more low-pressure pumps 238. For example, some embodiments may include multiple low-pressure pumps 234 and 238 to compensate for pressure losses in fluid lines (e.g., pipes, hoses). In operation, the rotary IPX 160 enables the first and second fluids (e.g., proppant free fluid and proppant laden fluid) to exchange work and pressure while reducing or blocking contact between the second fluid (e.g., proppant laden fluid, frac fluid) and the first fluid pumps 18. Accordingly, the frac system 10 is capable of pumping the second fluid at high pressures into the well 14, while reducing wear caused by the proppant (e.g., solid particulate) on the first fluid pumps 18 (e.g., high-pressure pump 236).

In operation, the first fluid low-pressure pump 234 receives the first fluid (e.g., proppant free fluid, substantially proppant free fluid) and increases the pressure of the first fluid for use by the first fluid high-pressure pump 236. The first fluid may be water from the water tank 244, or a combination of water from the water tank 244 and chemicals from the chemical tank 246. The first fluid high-pressure pump 236 then pumps the first fluid through a high-pressure inlet 240 and into the rotary IPX 160. The pressure of the first fluid then transfers to the second fluid (e.g., proppant containing fluid, such as frac fluid), entering the rotary IPX 160 through a second fluid low-pressure inlet 242. After exchanging pressure, the second fluid exits the rotary IPX 160 through a high-pressure outlet 250 and enters the well 14, while the first fluid exits at a reduced pressure through the low-pressure outlet 252. In some embodiments, the frac system 10 may include a boost pump 254 that further raises the pressure of the second fluid.

As the first and second fluids exchange pressures within the rotary IPX 160, some of the second fluid (e.g., leakage fluid) may combine with the first fluid and exit the rotary IPX 160 through the low-pressure outlet 252 of the rotary IPX 160. In other words, the fluid exiting the low-pressure outlet 252 may be a combination of the first fluid plus some of the second fluid that did not exit the rotary IPX 160 through the high-pressure outlet 250. In order to protect the first fluid pumps 18, the frac system 10 may direct a majority of the combined fluid (i.e., a mixture of the first and second fluids) to the mixing tank 256 where the combined fluid is converted into the second fluid by adding more proppant and chemicals. Any excess combined fluid not needed in the mixing tank 256 may be sent to a separator 300 (e.g., separator tank, hydro cyclone) where proppant is removed, converting the combined fluid into the first fluid. The substantially proppant free first fluid may then exit the separator 300 for recirculation through the first fluid pumps 18. The remaining combined fluid may then exit the separator tank 300 for use in the mixing tank 256. The ability to direct a majority of the combined fluid exiting the rotary IPX 160 into the mixing tank 256 enables the frac system 10 to use a smaller separator 300 while simultaneously reducing thermal stress in the frac system 10. For example, as the high-pressure pump 236 pressurizes the first fluid, the pressurization heats the first fluid. By sending a majority of the previously pressurized first fluid through the mixing tank 256 and then into the well 14, the frac system 10 reduces thermal stress on the first fluid pumps 18, the rotary IPX 160, and other frac system 10 components. Moreover, a smaller separator may reduce the cost, maintenance, and footprint of the frac system 10.

In the mixing tank, water 256, chemicals, and proppant are combined in the proper percentages/ratios to form the second fluid (e.g., frac fluid). As illustrated, the mixing tank 256 couples to the proppant tank 248, the chemical tank 246, the rotary IPX 160 through the low-pressure outlet 252, the separator 300, and the water tank 244. Accordingly, the mixing tank 256 may receive fluids and proppant from a variety of sources enabling the mixing tank 256 to produce the second fluid. For example, in the event that the combined fluid exiting the rotary IPX 160 through the low-pressure outlet 252 is insufficient to form the proper mixture of the second fluid, the frac system 10 may open a valve 302 enabling water from the water tank 244 to supplement the combined fluid exiting the rotary IPX 160. In order to block the flow of fluid from the water tank 244 into the separator 300 the frac system 10 may include check valves 303. After obtaining the proper percentages/ratios to form the second fluid (e.g., frac fluid), the second fluid exits the mixing tank 256 and enters the second fluid pumps 20. The second fluid pumps 20 then pump the second fluid (e.g., proppant-laden fluid, frac fluid) into the rotary IPX 160. In the rotary IPX 160, the first fluid contacts and increases the pressure of the second fluid driving the second fluid out of the rotary IPX 160 and into the well 14.

In order to control the composition (e.g., percentages of chemicals, water, and proppant) and flow of the first and second fluids, the frac system 10 may include a controller 260. For example, the controller 260 may maintain flow, composition, and pressure of the first and second fluids within threshold ranges, above a threshold level, and/or below a threshold level. The controller 260 may include one or more processors 262 and a memory 264 that receive feedback from sensors 266 and 268; and flow meters 270 and 272 to control the composition and flow of the first and second fluids into the rotary IPX 160. For example, the controller 260 may receive feedback from sensor 266 that indicates the chemical composition of the second fluid is incorrect. In response, the controller 260 may open or close a valve 274 to change the amount of chemicals entering the mixing tank 256. In some embodiments, the controller 260 may also monitor the percentage of proppant, water, etc. in the second fluid in the mixing tank 256 with the level sensor 268 (e.g., level control). If the composition is incorrect, the controller 260 may open and close valves 274, 282, and 302 to increase or decrease the flow of water, chemicals, and/or proppant into the mixing tank 256. In another situation, the controller 260 may receive a signal from the flow meter 272 that indicates the flow rate of the first fluid is too high or low. The controller 260 may then increase or decrease the speed of the low-pressure pump 234 to change the flow rate of the first fluid. The frac system 10 may also monitor the flow rate of the second fluid with the flow meter 270. If the flow rate of the second fluid is too high or low, the controller 260 may manipulate the valves 302 and 304; and/or increase/decrease the speed of the second pumps 20. In some embodiments, the controller 260 may also monitor a sensor 306 (e.g., vibration, optical, magnetic, etc.) that detects whether the rotary IPX 160 is no longer rotating (e.g., stalled). If the rotary IPX 160 stalls, the controller 160 may open a bypass valve 308 and close valves 304, 310, and 312 to block the flow of fluid from the low-pressure outlet 252 to the mixing tank 256, as well as block the flow of the first fluid through the first fluid pumps 18. The controller 260 may then open the valve 302 to pump water directly into the mixing tank 256 to produce the second fluid. The second fluid low-pressure pump 238 will then pump the second fluid through the rotary IPX 160 and bypass valve 308 to the first fluid pumps 18. The first fluid pumps 18 will then increase the pressure of the second fluid driving the second fluid through the rotary IPX 160 and into the well 14 for fracing. In this manner, the frac system 10 of FIG. 8 enables continuous fracing operations if the rotary IPX 160 stalls.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A pressure exchanger comprising:

one or more components configured to exchange pressure between a first fluid and a second fluid, wherein a controller is configured to control, based on first sensor data from a first sensor associated with the first fluid and second sensor data from a second sensor associated with the second fluid, one or more pumps, a first valve associated with the first fluid, and a second valve associated with the second fluid to vary corresponding flow of the first fluid and the second fluid entering the pressure exchanger to reduce mixing of the first fluid and the second fluid in the pressure exchanger, wherein the first sensor comprises a flow meter or a composition sensor associated with the first fluid, and wherein the second sensor comprises a flow meter or a composition sensor associated with the second fluid.

2. The pressure exchanger of claim 1 further comprising:

a shaft at least partially disposed in the pressure exchanger; and a motor coupled to the shaft.

3. The pressure exchanger of claim 1, wherein the pressure exchanger is configured to:

receive the first fluid via a first port;

provide the first fluid subsequent to pressure exchange via a second port;

receive the second fluid via a third port; and provide the second fluid subsequent to the pressure exchange via a fourth port.

4. The pressure exchanger of claim 1, wherein a barrier is disposed in the pressure exchanger to reduce mixing between the first fluid and the second fluid.

5. The pressure exchanger of claim 4, wherein the barrier is a fluid barrier.

6. The pressure exchanger of claim 1, wherein at least one of the first sensor data or the second sensor data comprises at least one of level sensor data, vibration data, optical data, or magnetic data.

7. The pressure exchanger of claim 1, wherein the controller is configured to maintain pressure of at least one of the first fluid or the second fluid at least one of within a threshold range, above a threshold level, or below a threshold level.

8. A system comprising:

a pressure exchanger configured to exchange pressure between a first fluid and a second fluid;

a plurality of sensors comprising a first sensor configured to provide first sensor data associated with the first fluid and a second sensor configured to provide second sensor data associated with the second fluid; and a controller configured to cause, based on the first sensor data and the second sensor data, control of one or more pumps, a first valve associated with the first fluid, and a second valve associated with the second fluid to vary corresponding flow of the first fluid and the second fluid entering the pressure exchanger to reduce mixing of the first fluid and the second fluid in the pressure exchanger, wherein the first sensor comprises a flow meter or a composition sensor associated with the first fluid, and wherein the second sensor comprises a flow meter or a composition sensor associated with the second fluid.

9. The system of claim 8, wherein the pressure exchanger further comprises:

a shaft at least partially disposed in the pressure exchanger; and a motor coupled to the shaft.

10. The system of claim 8, wherein the pressure exchanger is configured to:

receive the first fluid via a first port;

provide the first fluid subsequent to pressure exchange via a second port;

receive the second fluid via a third port; and provide the second fluid subsequent to the pressure exchange via a fourth port.

11. The system of claim 8, wherein a barrier is disposed in the pressure exchanger to reduce mixing between the first fluid and the second fluid.

12. The system of claim 11, wherein the barrier is a fluid barrier.

13. The system of claim 8, wherein at least one of the first sensor data or the second sensor data comprises at least one of flow rate data, fluid composition data, level sensor data, vibration data, optical data, or magnetic data.

14. The system of claim 8, wherein the controller is configured to maintain at least one of flow, composition, or pressure of at least one of the first fluid or the second fluid at least one of within a threshold range, above a threshold level, or below a threshold level.

15. A method comprising:

receiving, from a first sensor, first sensor data associated with a first fluid;

receiving, from a second sensor, second sensor data associated with a second fluid, wherein a pressure exchanger is configured to exchange pressure between the first fluid and the second fluid; and causing, based on the first sensor data and the second sensor data, one or more pumps, a first valve associated with the first fluid, and a second valve associated with the second fluid to vary corresponding flow of the first fluid and the second fluid entering the pressure exchanger to be controlled to reduce mixing of the first fluid and the second fluid in the pressure exchanger, wherein the first sensor comprises a flow meter or a composition sensor associated with the first fluid, and wherein the second sensor comprises a flow meter or a composition sensor associated with the second fluid.

16. The method of claim 15, wherein the pressure exchanger further comprises:

a shaft at least partially disposed in the pressure exchanger; and a motor coupled to the shaft.

17. The method of claim 15, wherein the pressure exchanger is configured to:

receive the first fluid via a first port;

provide the first fluid subsequent to pressure exchange via a second port;

receive the second fluid via a third port; and provide the second fluid subsequent to the pressure exchange via a fourth port.

18. The method of claim 15, wherein a barrier is disposed in the pressure exchanger to reduce mixing between the first fluid and the second fluid.

19. The method of claim 15, wherein at least one of the first sensor data or the second sensor data comprises at least one of flow rate data, fluid composition data, level sensor data, vibration data, optical data, or magnetic data.

20. The method of claim 15 further comprising maintaining at least one of flow, composition, or pressure of at least one of the first fluid or the second fluid at least one of within a threshold range, above a threshold level, or below a threshold level.

* * * * *